US009267368B2

(12) United States Patent
O'Malley et al.

(10) Patent No.: US 9,267,368 B2
(45) Date of Patent: Feb. 23, 2016

(54) FRACTURING MULTIPLE ZONES WITH INFLATABLES

(71) Applicant: Baker Hughes Incorporated, Houston, TX (US)

(72) Inventors: Edward J. O'Malley, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 327 days.

(21) Appl. No.: 13/872,267

(22) Filed: Apr. 29, 2013

(65) Prior Publication Data

US 2014/0318808 A1 Oct. 30, 2014

(51) Int. Cl.

| | |
|---|---|
| ***E21B 43/26*** | (2006.01) |
| ***E21B 33/12*** | (2006.01) |
| ***E21B 33/127*** | (2006.01) |
| ***E21B 43/14*** | (2006.01) |

(52) U.S. Cl.

CPC ..... *E21B 43/26* (2013.01); *E21B 33/1277* (2013.01); *E21B 43/14* (2013.01)

(58) Field of Classification Search

CPC ..... E21B 33/127; E21B 33/1272; E21B 33/1275; E21B 33/1277; E21B 43/26; E21B 43/14

USPC ..... 166/194, 318

See application file for complete search history.

(56) References Cited

U.S. PATENT DOCUMENTS

| | | | | |
|---|---|---|---|---|
| 2,798,557 | A * | 7/1957 | Sewell | 166/308.1 |
| 2,798,560 | A | 7/1957 | Allen et al. | |
| 2,923,358 | A * | 2/1960 | Hildebrandt | 166/113 |
| 4,655,286 | A | 4/1987 | Wood | |
| 5,295,393 | A * | 3/1994 | Thiercelin | 73/152.51 |
| 5,778,982 | A * | 7/1998 | Hauck et al. | 166/387 |
| 2011/0114334 | A1 * | 5/2011 | Palacios | 166/373 |
| 2011/0139456 | A1 | 6/2011 | Montgomery | |
| 2011/0284229 | A1 | 11/2011 | Radmanovich et al. | |
| 2013/0098621 | A1 * | 4/2013 | Hallundbæk et al. | 166/308.1 |
| 2014/0014340 | A1 * | 1/2014 | King | 166/285 |
| 2014/0196887 | A1 * | 7/2014 | Hallundbæk | 166/179 |

* cited by examiner

*Primary Examiner* — Robert E Fuller
*Assistant Examiner* — Christopher Sebesta
(74) *Attorney, Agent, or Firm* — Steve Rosenblatt

(57) ABSTRACT

One or more inflatables are used to initiate fractures in a formation. The onset of fractures after inflation to a predetermined pressure also results in damage to the inflatable and the ability to follow up the stress that initiated the fracture with high flow at high pressure to further propagate the initiated fractures at a location close to their origin. In another variation the inflatable can have openings that are small enough to allow inflation to initiate the fractures and yet continue to allow fluid flow through the openings to propagate the fractures. In yet another variation sliding sleeves with ball seats can be sequentially operated to inflate to fracture followed by opening an adjacent port to propagate.

14 Claims, 2 Drawing Sheets

FRACTURING MULTIPLE ZONES WITH INFLATABLES

FIELD OF THE INVENTION

The field of the invention is fracturing using inflatables and more particularly further propagating fractures made with each inflatable.

BACKGROUND OF THE INVENTION

Fracturing is a subterranean well production enhancing technique where fractures are initiated in a target formation, propagated, and then supported in the open state, thereby allowing ultimate production to the surface. Packers have been set in open hole as a technique to initiate fractures as described in US Publication 2011/0139456. However, this technique preferably used compression set packers and sliding sleeves 22 that were located uphole from each packer that could be selectively opened for production. Another design shown in US Publication 2011/0284229 showed a series of inflatable packers that incorporated sliding sleeves that were shifted with a shifting tool on a service string such as coiled tubing to open ports above the inflatable which fully encircled the production string. This design involved another trip in the hole to open the ports and positioning of the ports remotely from the packer since the inflatable fully surrounded the production string.

Other references with some relevance to the present invention include U.S. Pat. Nos. 2,798,560 and 4,655,286.

In U.S. Pat. No. 5,295,393 an inflatable sleeve is used to initiate fractures. Isolation inflatable packers are then set above and below the initiation location and a zone is isolated so that that fluid can be pumped into the zone to propagate the fractures. The sleeve that initiated the fractures is deflated after inflation and is located midway in the interval between the inflatable isolation packers.

What is needed and provided by the present invention is a technique that uses a 360 degree inflatable member to initiate fractures and then in a variety of ways propagates the initiated fractures with high flow rates at high pressure in the vicinity of the fracture initiation. One way this is done is to rupture the inflatable after it has created the initial fractures. Another way is to inflate the inflatable to the desired pressure while providing a network of openings in the inflatable. With enough flow under proper pressure the inflatable can still inflate to initiate fractures but thereafter the openings allow continuation of flow at the fracture initiation location. In another variation fracture extension ports can be opened without wellbore intervention after the inflatable is inflated. In this variation a ball lands on a seat in a first shifting sleeve to open access to the inflatable to initiate the fracture and another sliding sleeve with a ball seat then accepts a different ball to shift open a port through which the already initiated fracture is further propagated. These and other aspects of the invention will be more readily apparent to those skilled in the art from a review of the description of the preferred embodiment and the associated drawings while recognizing that the full scope of the invention is to be determined from the appended claims.

SUMMARY OF THE INVENTION

One or more inflatables are used to initiate fractures in a formation. The onset of fractures after inflation to a predetermined pressure also results in damage to the inflatable and the ability to follow up the stress that initiated the fracture with high flow at high pressure to further propagate the initiated fractures at a location close to their origin. In another variation the inflatable can have openings that are small enough to allow inflation to initiate the fractures and yet continue to allow fluid flow through the openings to propagate the fractures. In yet another variation sliding sleeves with ball seats can be sequentially operated to inflate to fracture followed by opening an adjacent port to propagate.

DETAILED DESCRIPTION OF THE PREFERRED EMBODIMENT

Figure 1:
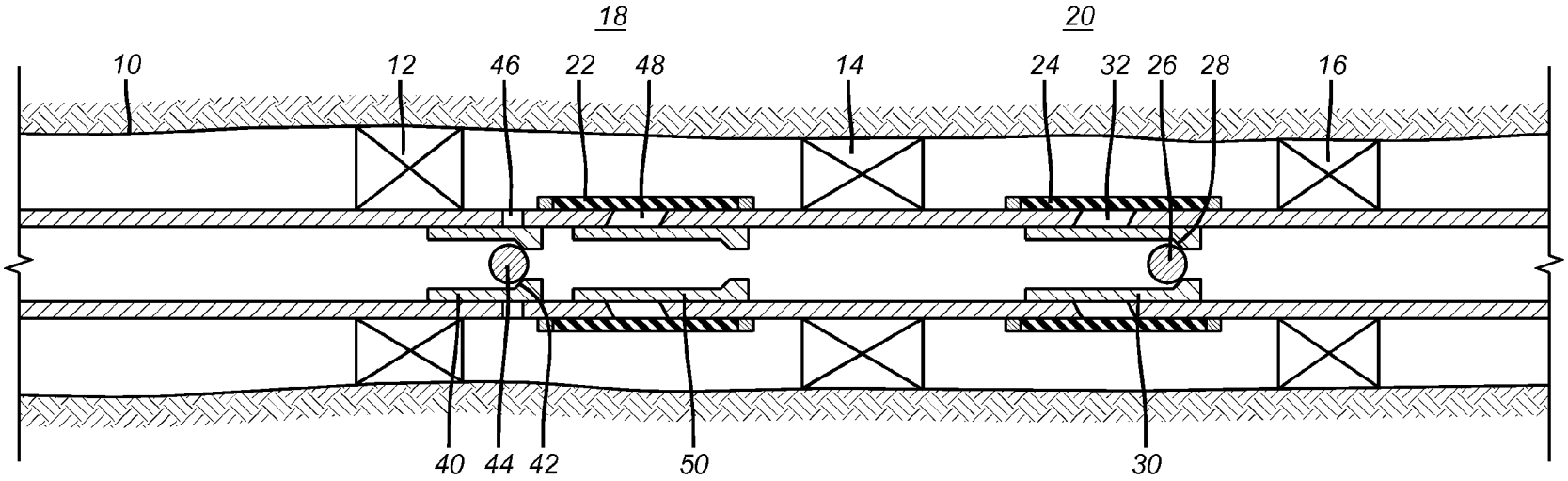
FIG. 1 is an illustration of an array of inflatables for fracturing and showing an optional access sleeve to open a port for further propagation of fractures initiated with the inflatables.
Figure 2:
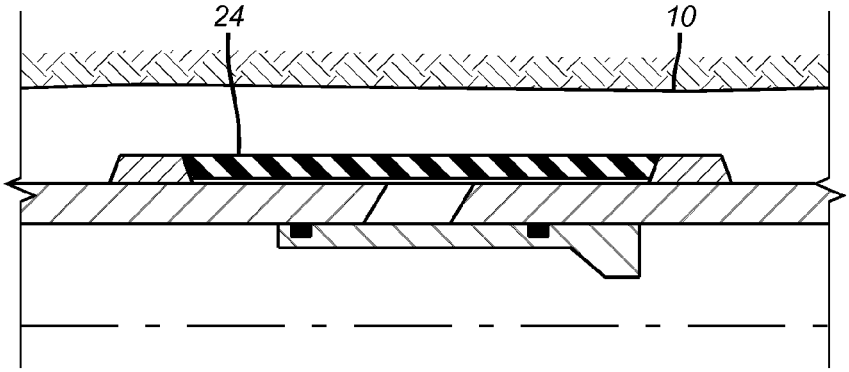
FIG. 2 is a detailed view of a shifting sleeve that allows access for inflation of an inflatable.
Figure 3:
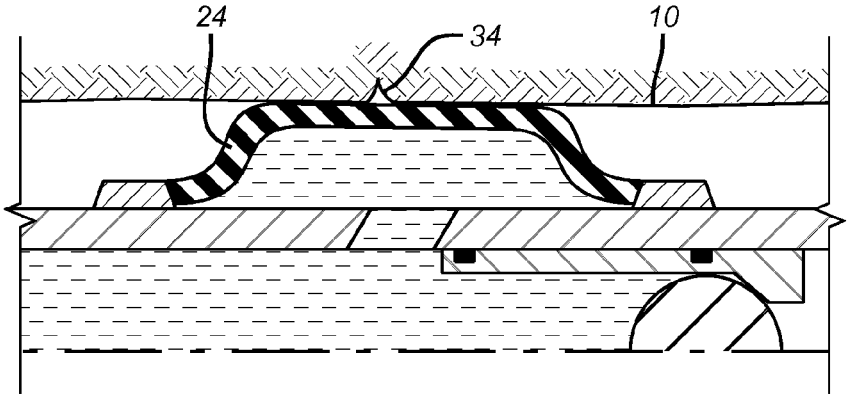
FIG. 3 is the view of FIG. 2 with the sleeve shifted and the inflatable inflated to initiate fractures.
Figure 4:
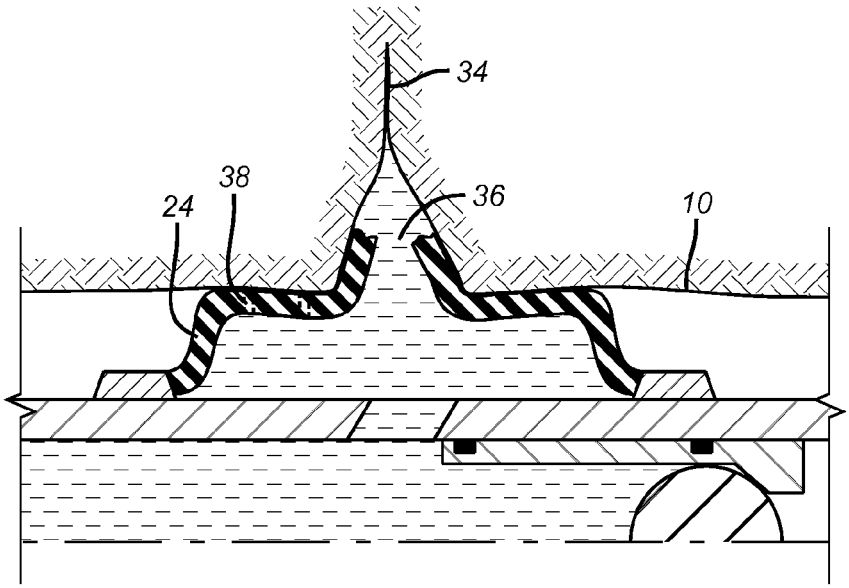
FIG. 4 is the view of FIG. 3 with the inflatable ruptured by entering the fractures created to allow pressurized fluid to further propagate the fractures.

FIG. 1 illustrates an open hole wellbore 10 where open hole packers 12, 14 and 16 isolate zones 18 and 20. Those skilled in the art will appreciate that the number of zones illustrated is illustrative and that in general with the exception of a lowermost zone that a pair of spaced packers will either identify a single zone or subparts thereof. In the illustrated embodiment, zone 18 has an inflatable 22 and zone 20 has an inflatable 24. The inflatables extend for 360 degrees and are accessed for inflation by landing a ball 26 on a seat 28 that is mounted to a sliding sleeve 30 to selectively expose the port 32 so that inflate fluid can enter the inflatable 24. Access to subsequent inflatables proceeds in a direction from the lowermost inflatable toward the other inflatables working in a direction toward the well surface. Progressively larger balls can be dropped as one way of controlling the landing locations to occur in the desired sequence. Inflation of the inflatable 24 is shown in FIG. 3 where the inflatable member is in contact with the borehole 10 to initiate the fracture 34. FIG. 4 shows that further inflation and addition of stress to the borehole 10 by the inflatable 24 can do two things. First is that the initial fracture 34 has grown quite larger in a direction that is radial to the borehole 10. At the borehole wall the fracture becomes large enough to allow a portion of the inflatable member 24 to enter the fracture 34 or to reach a degree of expansion so large that one or more leaks 36 develop in the element so that fluid under high pressure within the inflated the inflatable element 24 now is delivered in the precise location of the origin of the fracture 34 to optimize further propagation of the fracture 34 from its source. The surface pumping equipment can provide the needed pressure levels and flow rates required for desirable propagation of the fractures 34 in a radial direction with respect to the borehole 10, and the addition of fracture propping agents to the fluid will erode away the damaged inflatable element, further increasing the area available for flow into the fracture.

In a variation, the inflatable element such as 24 can be slightly permeable, featuring fluid pathways through the element 38 that still cause it to rapidly inflate during pumping, thereby delivering the required stress to the surrounding formation on a 360 degree basis to start a fracture such as 34, but instead of ripping up or being otherwise destroyed in the fracture 34 the inflatable at least for a time stays inflated and delivers fluid that further extends the fracture 34. It can also happen that after a time under such flow conditions that the fluid pathways can grow in size and maybe join together by means of erosion.

Another optional technique is also illustrated in FIG. 1. A second sleeve 40 has a ball seat 42 and accepts a ball or other blocking object 44 to shift the sleeve 40 to expose ports 46 after ports 48 have already been earlier exposed with another ball or object landed on sleeve 50. Thus at each inflatable a first sleeve such as 50 opens access to the inflatable to allow delivered pressure to initiate the fracture. The delivered pressure can fail the inflatable such as 22 in the manners described above such as tearing or making existing openings larger. Then a ball or other object 44 is dropped into adjacent sleeve 40. The dropping of the second ball or object allows the inflatable such as 22 to deflate. Shifting the sleeve such as 40 then can not only open ports 46 but can also close ports 48 to make sure the inflatable such as 22 is not re-inflated as it has already served its purpose to initiate a fracture as in 34 and re-inflating it would block access to the initiated fracture 34 by the high pressure fluid coming from ports 46. Alternatively, if the inflatable has already been failed from its initial inflation then closing its access port 48 allows all the flow for propagation to exit ports 46 that are close by but necessarily out of the way of remnants of the inflatable such as 22. It is preferable to put the ports 46 as close as possible to the adjacent inflatable such as 22. Those skilled in the art will appreciate that the same procedure can take place at each inflatable working in order from the lowermost inflatable and in the uphole direction with progressively larger balls or other objects to successively land in sleeves for inflation of the inflatable and then in the next sleeve up for deflation of the inflatable and opening ports to allow fluid at high pressure and flow rates to propagate the fracture from a vantage point as close as possible to where the fracture started.

The above description is illustrative of the preferred embodiment and many modifications may be made by those skilled in the art without departing from the invention whose scope is to be determined from the literal and equivalent scope of the claims below:

We claim:

1. A fracturing method, comprising:
positioning at least one inflatable member adjacent at least one subterranean formation;
providing openings in said inflatable member before inflation that still allow said inflatable member to extend and initiate said fractures;
inflating said inflatable member against the formation to initiate fractures and enlarging said openings;
propagating said initiated fractures to make said initiated fractures larger with flow through said now enlarged openings in said inflatable member.

2. The method of claim 1, comprising:
deflating said inflatable member before or during said propagating.

3. The method of claim 1, comprising:
opening an access port to said inflatable member before said inflating;
deflating said inflatable member after said inflating;
isolating said access port to prevent re-inflating;
opening a mandrel wall port adjacent said inflatable member;
propagating said fracture through said wall port.

4. The method of claim 3, comprising:
shifting a first sleeve to open said access port for said inflating;
shifting a second sleeve to open said wall port for said propagating.

5. The method of claim 4, comprising:
closing said access port with said second sleeve.

6. The method of claim 3, comprising:
dropping an object on a seat in a first sleeve to open said access port;
dropping another object on a seat in a second sleeve to allow said inflatable member to deflate.

7. A fracturing method, comprising:
positioning at least one inflatable member adjacent at least one subterranean formation;
providing openings in said inflatable member before inflation that still allow said inflatable member to extend and initiate said fractures;
inflating said inflatable member against the formation to initiate fractures;
enlarging said openings with said inflating and fracture initiation;
propagating said initiated fractures to make said initiated fractures larger with flow through a selectively opened port on a mandrel for said inflatable member that initiated said fractures.

8. The method of claim 7, comprising:
blocking an access port to said inflatable member after said enlarging.

9. The method of claim 7, comprising:
initially opening an access port to said inflatable member with a first shifting sleeve.

10. The method of claim 9, comprising:
closing said access port to said inflatable member with a second shifting sleeve.

11. The method of claim 10, comprising:
opening said selectively opened port with said second shifting sleeve.

12. The method of claim 11, comprising:
moving said first and second shifting sleeves with pressure against an object placed in said first and second shifting sleeves.

13. The method of claim 12, comprising:
using a smaller object in said first shifting sleeve than in said second shifting sleeve.

14. The method of claim 7, comprising:
failing said inflatable member by flowing through openings in said inflatable member that enlarge due to flow through said openings.

* * * * *